United States Patent [19]

Buys

[11] 4,253,654

[45] Mar. 3, 1981

[54] PILE HEIGHT SENSOR IN A SHEET DISPENSING MACHINE FOR DISPENSING SHEETS ONE BY ONE

[75] Inventor: Henri Buys, Breux, France

[73] Assignee: Transac—Compagnie pour le Developpement des Transactions Automatiques, Paris, France

[21] Appl. No.: 939,618

[22] Filed: Sep. 5, 1978

[30] Foreign Application Priority Data

Sep. 26, 1977 [FR] France ..... 77 28958

[51] Int. Cl.[3] ..... B65H 1/16

[52] U.S. Cl. ..... 271/155

[58] Field of Search ..... 271/152, 154, 155, 156, 271/25, 31, 38, 130; 250/231 R, 237 R, 561

[56] References Cited

U.S. PATENT DOCUMENTS 1,946,988 2/1934 Schueler ..... 271/154

2,272,457 2/1942 Broadmeyer .

3,968,364 7/1976 Miller ..... 250/231 R X

*Primary Examiner*—Richard A. Schacher

*Attorney, Agent, or Firm*—Sughrue, Rothwell, Mion, Zinn and Macpeak

[57] ABSTRACT

A pile height sensor in a sheet automatic dispenser machine for dispensing sheets one by one, said pile height sensor including a lift tray on which a pile of sheets rests, characterized in that it includes a lever which has a first arm and a second arm rotatably mounted on a stationary pivot pin, which is integral with the frame of the machine, a small thin resilient blade being fixed to the end of the first arm of the lever and resting on the top of the pile of sheets, a spring bearing against the second arm of the lever in the vicinity of the pivot pin, the spring being compressed by an adjusting screw.

The invention applies in particular to bank-note dispensers.

2 Claims, 3 Drawing Figures

PILE HEIGHT SENSOR IN A SHEET DISPENSING MACHINE FOR DISPENSING SHEETS ONE BY ONE

FIELD OF THE INVENTION

The present invention relates to a pile height sensor in a sheet dispenser machine for dispensing sheets one by one.

BACKGROUND OF THE INVENTION

In known devices, such as the one described in French Pat. No. 2,231,221 filed on 23rd May 1973, for a sheet dispenser machine for dispensing sheets one by one, there is a component called a pile height sensor which is constituted by a small thin resilient blade which rests on the front part of the top sheet of the pile and exerts a light pressure thereon by its natural spring effect. When the level of the pile is lowered by the removal of a few sheets, this pile height sensor actuates a contact which starts a motor to raise the level of the pile of sheets.

However, with such a device, it is not possible to adjust the pressure exerted by the sheet feeder blade on the pile. This pressure may be considered as a constant pressure because of the small number of sheets removed between two starts of the motor for raising the level of the pile. Now, the pressure of the sheet feeder blade is a very important parameter for the proper operation of a dispenser and this pressure must be adjustable as a function of the physical characteristics of the sheets to be removed.

The present invention aims to produce a pile height sensor for exerting an easily adjustable pressure at the top of the pile of sheets to be removed.

SUMMARY OF THE INVENTION

The present invention provides a pile height sensor in a sheet dispenser machine for dispensing sheets one by one, said pile height sensor including a lift tray on which a pile of sheets rests, characterized in that it includes a lever which has a first arm and a second arm rotatably mounted on a stationary pivot pin, which is integral with the frame of the machine, a small thin resilient blade being fixed to the end of the first arm of the lever and resting on the top of the pile of sheet's. A spring bears against the second arm of the lever in the vicinity of the pivot pin, the spring being compressed by an adjusting screw.

According to another characteristic of the invention, the lift tray is driven by a motor which is started and stopped by the movement of the end of the second arm of the lever which masks or unmasks a stationary electro-optical device.

According to another characteristic of the invention, the level of the top of the pile of sheets is adjusted by adjusting the position of the electro-optical device by means of an adjusting screw which presses against a resilient blade on which the electro-optical device is fixed.

According to one embodiment of the invention, said lever is substantially L-shaped, the pivot pin being situated in the vicinity of the meeting point of the two arms.

According to a particular embodiment of the invention, said motor stops when the second arm of the lever masks the electro-optical device and starts when the second arm of the lever unmasks the electro-optical device due to the rotation of the lever when a few sheets are removed.

According to another characteristic of the invention, the second arm of the lever further includes a rigid tongue which actuates an emergency switch which stops the motor when the second arm of the lever, having masked the electro-optical device, continues to rotate, while the motor does not stop due to a breakdown.

Thus there is a sheet dispenser machine in which the sheet feeder blade pressure may be accurately adjusted on the top of the pile of sheets. This pressure, once adjusted, remains constant throughout the whole sheet distribution if the adjustment is not changed since, firstly, the spring which exerts pressure bears against a point near the pivot pin and is slightly elongated when sheets are removed, and secondly the number of sheets removed between each pile lift is small (about 3 to 7). (This is because the motor is started and stopped by a single component, namely the masking and unmasking of an electro-optical device, and the stop time during which a few sheets are extracted is determined solely by the inertia of the motor). A constant pressure pile height sensor, whose pressure may be very accurately adjusted, is thereby provided.

An embodiment of the invention is described hereinbelow by way of example with reference to the accompanying drawings:

DESCRIPTION OF THE PREFERRED EMBODIMENT

The figures show: an assembly with a fixed support 1 integral with a frame of a dispenser machine (not shown); a lift tray (not shown) on which there rests a pile of notes 2; a motor; drive means for lifting the tray; and extraction means 20.

Figure 1:
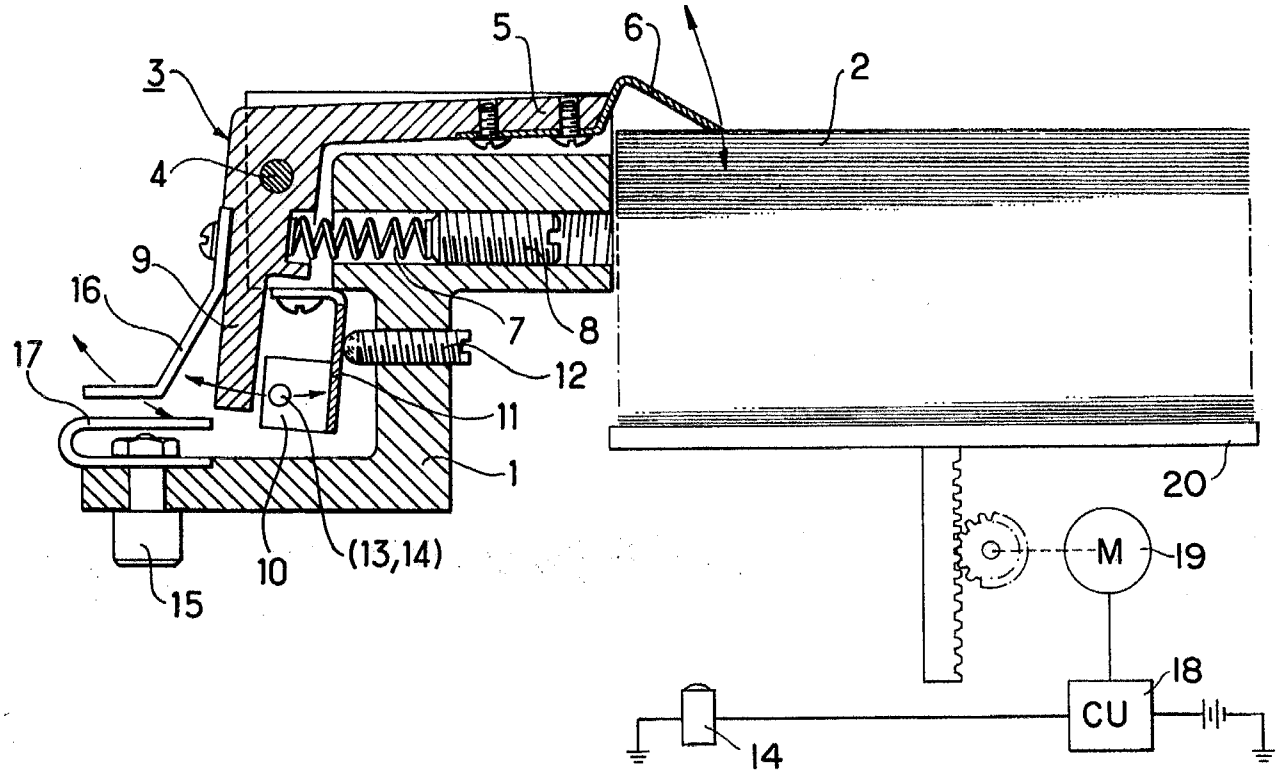
FIG. 1 is a vertical sectional view which shows a pile height sensor in accordance with the invention applied for example to a bank-note dispenser.
Figure 2:
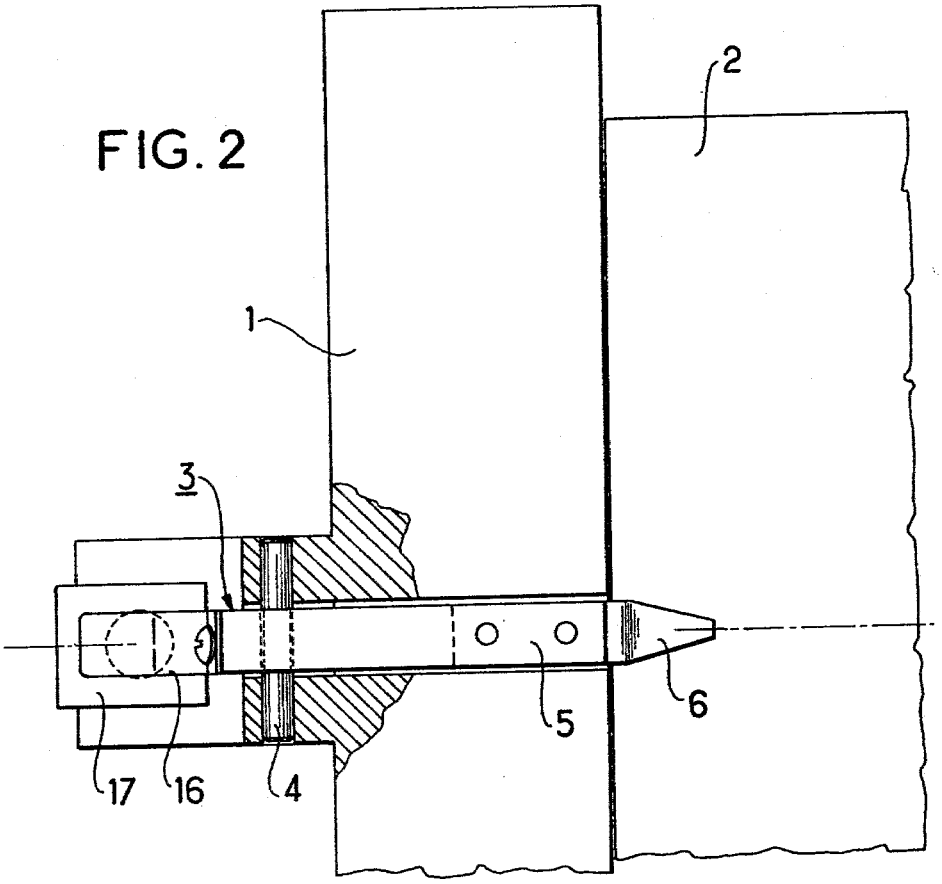
FIG. 2 is a plan view partially broken away of FIG. 1.
Figure 3:
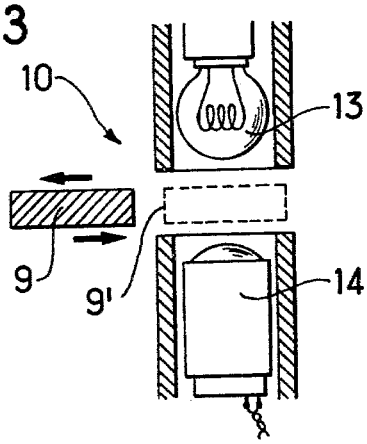
FIG. 3 is a sectional view of the sheet feeder which shows a detail of FIG. 1.

In accordance with the invention, the pile height sensor includes a movable L-shaped lever 3 rotatably mounted on a stationary pivot pin 4 which is integral with the support 1. The lever 3 includes a first arm 5 at the end of which is fixed a small thin resilient sheet feeder blade 6 which is called the sheet feeder proper. The pile height sensor blade 6 rests on the top of the pile of notes 2. The sheet feeder blade 6 presses on the pile of notes 2 by means of a spring 7 whose pressure is adjusted accurately by means of an adjusting screw 8. The spring bears against a second arm 9 of the lever 3, near its pivot 4. The device further includes an electro-optical device 10, e.g. a photo-coupler, installed on a resilient blade 11 fixed on the support 1. The position of the photo-coupler 10 is adjusted by an adjusting screw 12 by deformation of the resilient blade 11. FIG. 3 is a horizontal cross-section of the photo-coupler 10 and of the end of the second arm 9 of the lever 3. The assembly comprises two parts separated by a gap in which the end of the second arm 9 of the lever 3 may pass. The first part includes a light source 13 and the second part includes an optical sensor 14. The sensor 14 is connected to control units 18, for controlling the tray lift motor 19 on which tray 20 the pile 2 of notes rests.

When the top of the pile of notes 2 is lowered subsequent to the removal of a few notes, the end of the second arm 9 leaves said gap and unmasks the electro-optical device which then controls the note tray lift motor 19 until the pile has risen sufficiently for the end of the second arm 9 to interrupt the light beam emitted by the source 13 a second time. The optical sensor 14 then controls the stopping of the motor. Due to the inertia of the motor, a few notes—about 3 to 7 —may be removed between two motor starts. It is seen that since the position of the photo-coupler 10 may be adjusted by means of the adjusting screw 12, the level of the top note of the pile 2 may be adjusted accurately.

The assembly further includes an emergency device so as to prevent the mechanical blocking of the tray lift movement from causing the destruction of the device and in particular to prevent the motor from being burnt out in the case where, due to a breakdown of the control device, the motor does not stop as anticipated although the end of the second arm has interrupted the light beam of the source 13.

This device comprises a mechanical switch 15 actuated by a rigid tongue 16 fixed on the second arm 9 of the lever 3. The switch 15 has a spring 17 which is designed to rapidly increase the torque applied to the sheet feeder blade 6 and to remove the causes of excessive elevation of the sheet feeder blade 6 which are not due to the serious defect mentioned hereinabove.

I claim:

1. A pile height sensor in a sheet dispensing machine for dispensing sheets one by one, said sheet dispensing machine including a frame, said pile height sensor including a lift tray on which a pile of sheets rests, the improvement wherein said pile height sensor includes a lever rotatably mounted on a stationary pivot pin, said pin being integral with the frame of the machine, said lever including a first arm and a second arm, a small thin first resilient blade being fixed to the end of the first arm of the lever and resting on the top of the pile of sheets, a spring mounted to said frame and bearing against the second arm of the lever in the vicinity of the pivot pin for biasing the first lever arm towards said pile of sheets, an adjusting screw for varying the compression of said spring, a motor for driving said lift tray, said motor being started and stopped by the movement of the end of the second arm of said lever which masks or unmasks a stationary electro-optical device, and means for fixing said electro-optical device to said said second resilient blade, and a second adjusting screw in pressing contact against said second resilient blade on which said electro-optical device is fixed for deflecting said second blade and said electro-optical device; whereby, the level of the top of the pile of sheets is varied by adjusting said second adjusting screw.

2. A pile height sensor according to claim 1, wherein: the second arm of the lever further includes a rigid tongue which actuates an emergency switch which stops the motor when the second arm of the lever, having masked the electro-optical device, continues to rotate, while the motor does not stop due to a breakdown.

* * * * *